US012031805B1

(12) United States Patent
Elfers et al.

(10) Patent No.: US 12,031,805 B1
(45) Date of Patent: Jul. 9, 2024

(54) AMMUNITION TRAYS AND METHODS

(71) Applicants: Todd Elfers, Eau Claire, WI (US); Scott Peterson, Eau Claire, WI (US)

(72) Inventors: Todd Elfers, Eau Claire, WI (US); Scott Peterson, Eau Claire, WI (US)

( * ) Notice: Subject to any disclaimer, the term of this patent is extended or adjusted under 35 U.S.C. 154(b) by 105 days.

(21) Appl. No.: 17/839,954

(22) Filed: Jun. 14, 2022

Related U.S. Application Data

(60) Provisional application No. 63/216,787, filed on Jun. 30, 2021.

(51) Int. Cl.
*F42B 39/26* (2006.01)
*F42B 33/00* (2006.01)

(52) U.S. Cl.
CPC ..... *F42B 39/26* (2013.01); *F42B 33/001* (2013.01)

(58) Field of Classification Search
CPC ..... F42B 33/001; F42B 33/002; F42B 33/22; F42B 39/22; F42B 39/26; F42B 99/00; F42B 39/00; F42B 39/14; F42B 39/24; F42B 39/28; A45F 2200/05; A61J 1/16; B65D 25/10; B65D 25/108
USPC ..... 33/506; 42/1.08, 1.09, 1.14, 1.15, 1.16, 42/6, 7, 15, 16, 17, 18, 19, 22, 28, 32, 42/38, 39.5, 49.01, 50, 51, 54, 55, 60, 61, 42/68, 69.01, 69.02, 69.03, 70.05, 70.06, 42/71.01, 73, 74, 77, 87, 88, 89, 90, 96, 42/99, 118, 124; 81/3.8, 177.4, 439, 490; 86/1.1, 10, 12, 19.5, 19.6, 19.7, 20.12, 86/20.13, 23, 24, 25, 26, 27, 28, 29, 30, 86/31, 32, 33, 36, 37, 38, 39, 40, 41, 43, 86/44, 45, 46, 49, 50; 89/1.1, 1.14, 1.2, 89/1.41, 1.57, 9, 11, 13.05, 14.1, 20.2, 89/26, 27.11, 29, 33.01, 33.02, 33.1, 89/33.14, 33.16, 33.2, 33.25, 33.5, 34, 89/35.01, 37.14, 46, 129.01, 129.02, 132, 89/140, 146, 149, 154, 155, 175, 189, 89/192, 198, 1.4, 128, 139, 148, 152, 89/191.01, 193, 36.01, 36.02, 36.03, 89/36.04, 36.06, 36.07, 36.08, 36.17, 89/37.01, 37.03, 37.04, 40.06, 902, 903, 89/904, 906, 907, 908, 909, 910, 917, 89/930; 102/233, 234, 235, 267, 274, 102/340, 346, 358, 365, 366, 367, 370, 102/382, 424, 438, 439, 446, 449, 469, 102/470, 476, 482, 483, 486, 488, 503, 102/505, 523; 124/37, 50, 82; 206/1.5, 206/3, 15.3, 37, 38, 63.5, 213.1, 223,
(Continued)

(56) References Cited

U.S. PATENT DOCUMENTS 6,132,684 A * 10/2000 Marino ..... B01L 9/06 422/561

* cited by examiner

*Primary Examiner* — Anthony D Stashick
*Assistant Examiner* — Marcos Javier Rodriguez Molina
(74) *Attorney, Agent, or Firm* — Anthony J. Bourget

(57) ABSTRACT

Devices, systems, and methods of using ammunition cartridge blocks to hold a plurality of cartridges upright, including a first layer having a plurality of openings configured to receive the plurality of ammunition cartridges, a second layer having a plurality of holes alignable with the plurality of openings and configured to receive the plurality of ammunition cartridges, the second layer positioned above the first layer, and a third layer having a plurality of holes aligned with the plurality of openings and configured to receive the plurality of ammunition cartridges, the third layer positioned above the second layer, the second layer adjustable with respect the first layer. An operator may adjust the second layer to lock the plurality of cartridges into position.

24 Claims, 9 Drawing Sheets

(58) Field of Classification Search
USPC ..... 206/232, 253, 265, 305, 308.1, 308.3, 206/313, 315.1, 315.11, 317, 369, 372, 206/385, 387.15, 388, 393, 427, 443, 446, 206/480, 485, 486, 499, 509, 511, 521, 206/523, 524.8, 526, 538, 539, 558, 561, 206/564, 565, 576, 579, 584, 585, 586, 206/589, 591, 593, 597, 702, 811, 815, 206/821, 823, 18, 196, 199, 217, 224, 206/239, 366, 370, 42, 477, 600, 931; 220/4.21, 62.22, 277, 583; 221/1, 66, 221/185, 290, 306, 310; 222/1, 5, 82, 88, 222/95, 105, 108, 148, 182, 183, 192, 222/325, 326, 327, 362, 386, 386.5, 389, 222/391, 402.15, 482, 509; 224/163, 182, 224/183, 196, 223, 239, 240, 241, 245, 224/247, 248, 249, 251, 544, 602, 603, 224/616, 627, 663, 666, 667, 673, 674, 224/677, 678, 679, 681, 682, 918, 931; 264/39, 40.1, 40.4, 84, 156, 158; 29/222, 29/240, 25.02, 252, 254, 256, 257, 260, 29/261, 269, 271, 27 R, 281.1, 281.4, 29/281.6, 33.52, 33 P, 35.5, 401.1, 29/402.03, 402.08, 407.1, 423, 426.2, 29/426.4, 426.5, 428, 429, 430, 432, 446, 29/455.1, 463, 464, 466, 505, 506, 509, 29/513, 520, 523, 524.1, 525, 525.01, 29/560, 563, 57, 592.1, 598, 753, 809
See application file for complete search history.

AMMUNITION TRAYS AND METHODS

CROSS-REFERENCE TO RELATED APPLICATIONS

This application claims the benefit of and priority to, U.S. Provisional Patent Application Ser. No. 63/216,787 filed Jun. 30, 2021 for AMMUNITION TRAYS AND METHODS, incorporated herein by reference in its entirety for continuity of disclosure.

BACKGROUND OF THE INVENTION

Ammunition trays or blocks are used to hold ammunition cartridges for purposes of loading and/or reloading the cartridges. The trays or blocks typically include a base having several holes or slots for retaining several cartridges in an upstanding orientation. While such trays or blocks have benefits, there is room for improvement.

SUMMARY OF THE INVENTION

In one aspect the present invention pertains to an ammunition block configured to hold or lock cartridges within several holes or slots. The block includes at least a first bottom layer having a plurality of holes or slots over which is positioned at least another or second layer having a plurality of holes or slots. The holes are configured to receive a plurality of ammunition cartridges. The second or upper layer translates with respect to the first layer to hold or lock the cartridges into position within the holes or slots.

In a further aspect a device includes a first layer having a plurality of openings configured to receive a plurality of ammunition cartridges, a second layer having a plurality of holes alignable with the plurality of openings and configured to receive the plurality of ammunition cartridges, the second layer positioned above the first layer, and a third layer having a plurality of holes aligned with the plurality of openings and configured to receive the plurality of ammunition cartridges, the third layer positioned above the second layer, the second layer adjustable with respect the first layer. A user may translate the second layer with respect to the first layer (and the third layer) which adjusts the holes of the second layer so that edges of the holes abut against the cartridges. The edges move or force the cartridges against respective edges or walls associated with the holes of the third layer and/or against edges or walls associated with corresponding openings of the first layer to securely hold the cartridges.

In further aspects the invention includes a method of securing an ammunition cartridge within a block, the method including positioning a first cartridge into a first hole of a third layer and through a first hole of a second layer and into a first opening of a first layer of a block, and translating the second layer such that an edge or edges of the first hole of the second layer abut the first cartridge. In aspects, an edge or edges of the first hole of the third layer (or of the first layer) also abut the first cartridge.

The above partial summary of the present invention is not intended to describe each illustrated embodiment, aspect, or every implementation of the present invention. The figures and detailed description and claims that follow more particularly exemplify these and other embodiments and further aspects of the invention.

Figure 2:
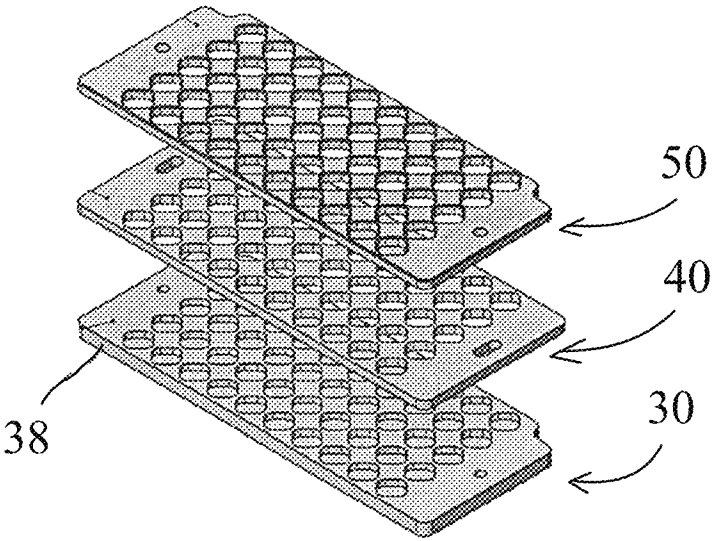
FIG. 2 is an exploded view of the device of FIG. 1.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Figure 1:
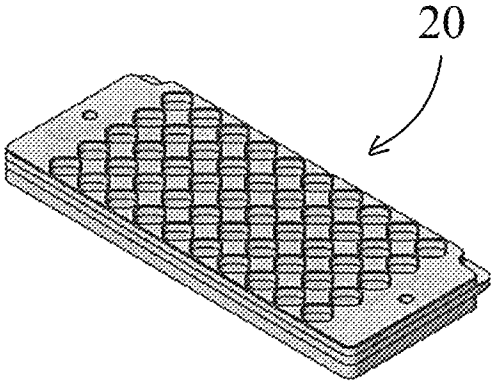
FIG. 1 is a front perspective view of an ammunition cartridge block device in accordance with one aspect of the invention.

Referring to FIGS. 1-17, aspects of the devices, systems and methods are shown. FIG. 1 and FIG. 2 depict one aspect of a device or ammunition cartridge block 20 having a set of three layers, including a bottom layer or first layer 30, an intermediate, middle or second layer 40, and an upper or top or third layer 50. Additional or fewer layers may be used for the device 20.

Figure 9:
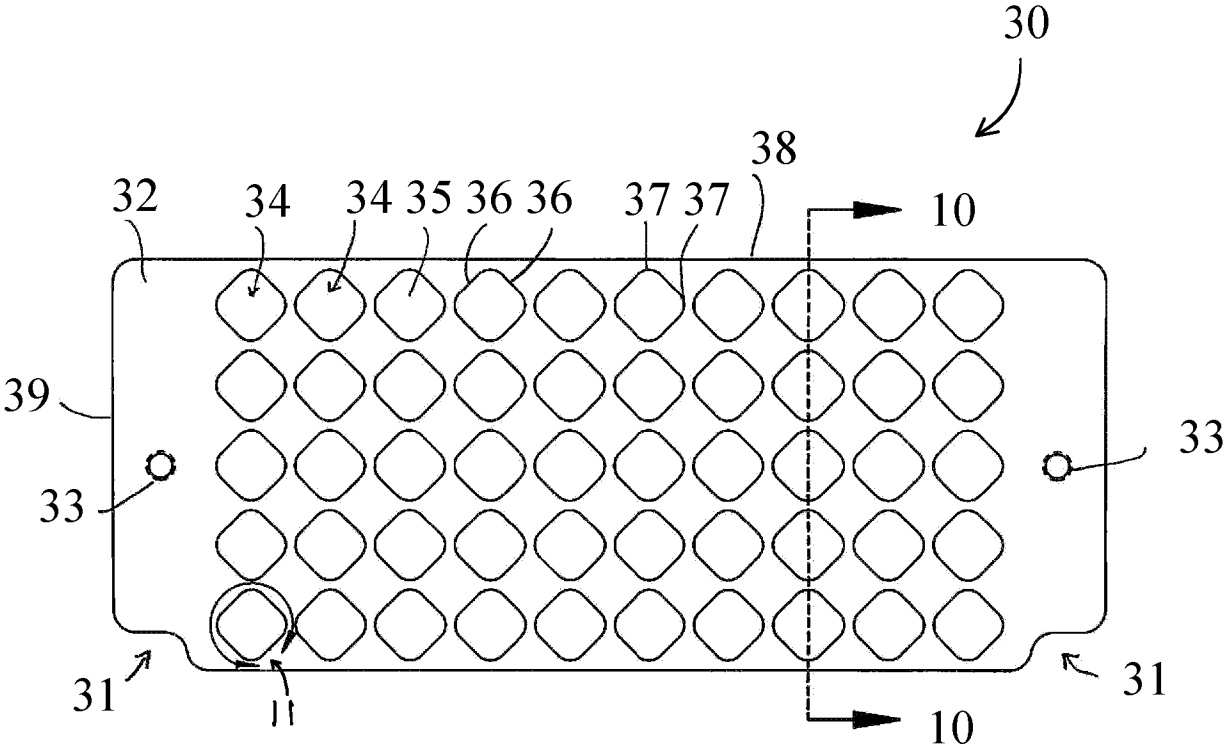
FIG. 9 is a top view of a bottom layer component of the device of FIG. 7.
Figure 11:
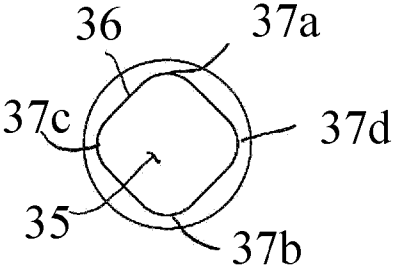
FIG. 11 is a partial top view of a feature aspect of the device taken along the detail reference arrows 11 of FIG. 9.
Figure 10:
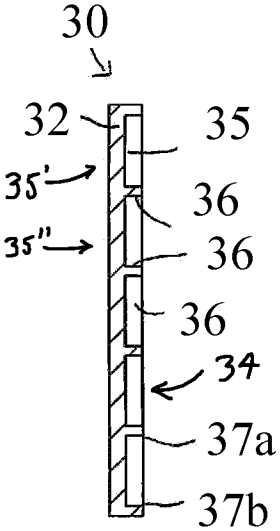
FIG. 10 is a section view taken along line 10-10 of FIG. 9.
Figure 12:
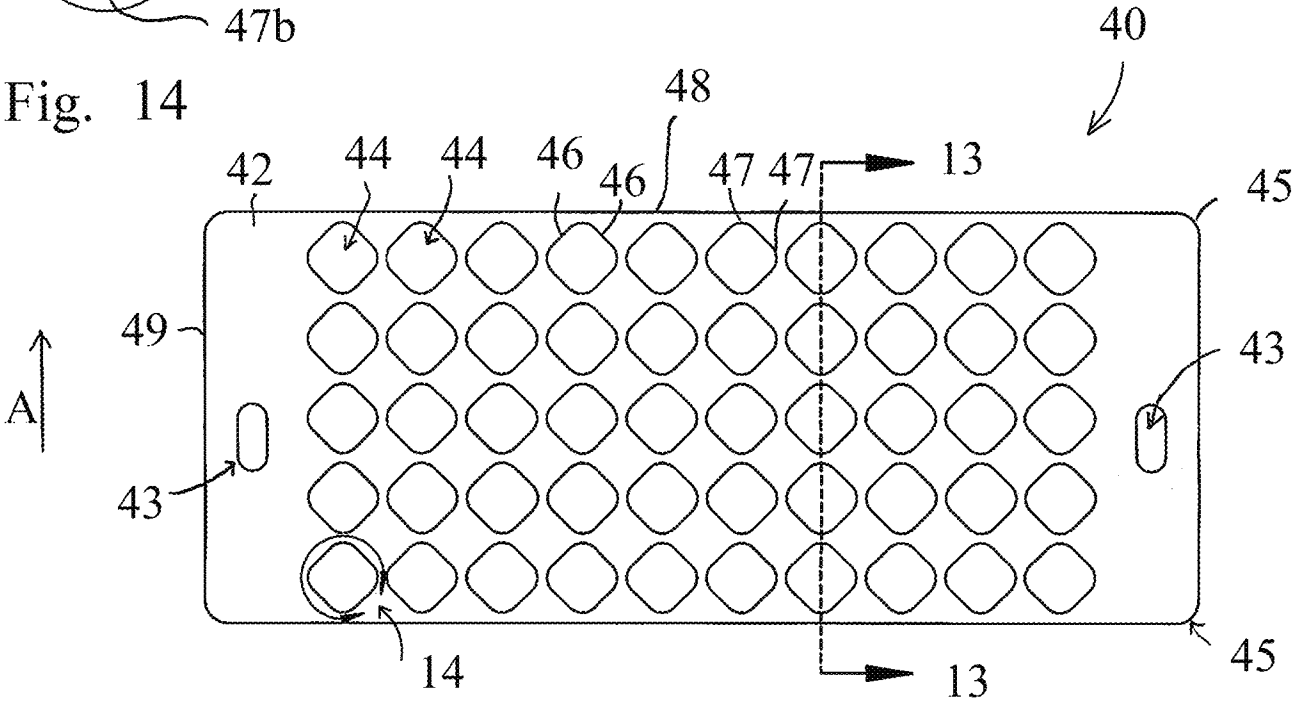
FIG. 12 is a top view of a middle layer component of the device of FIG. 7.
Figure 14:
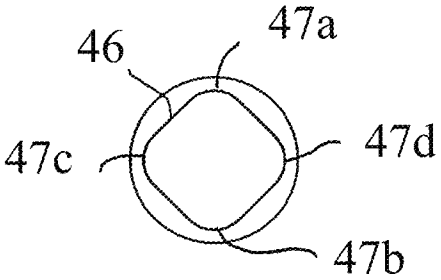
FIG. 14 is a partial top view of a feature aspect of the device taken along the detail reference arrows 14 of FIG. 12.
Figure 13:
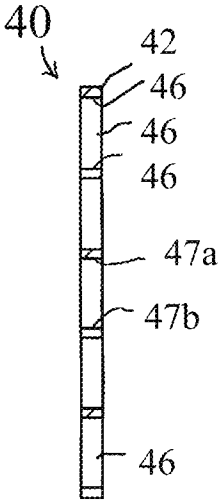
FIG. 13 is a section view taken along line 13-13 of FIG. 12.
Figure 15:
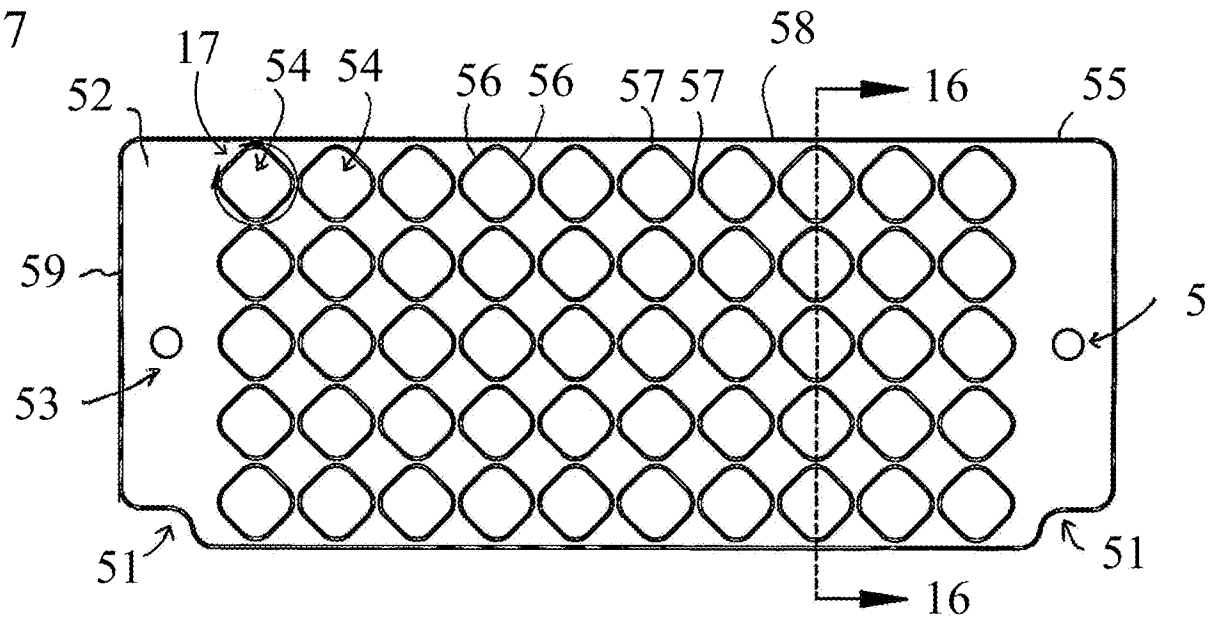
FIG. 15 is a top view of an upper layer component of the device of FIG. 7.
Figure 17:
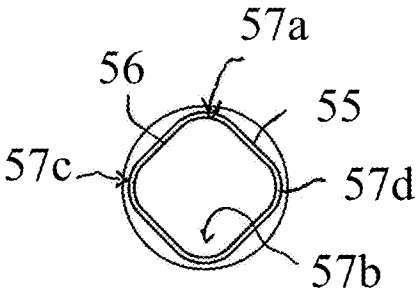
FIG. 17 is a partial top view of a feature aspect of the device taken along the detail reference arrows 17 of FIG. 15.
Figure 16:
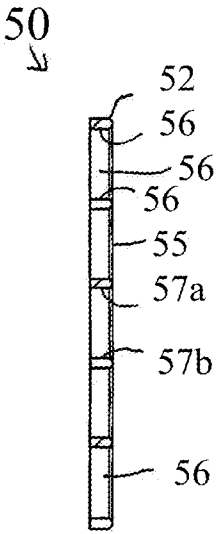
FIG. 16 is a section view taken along line 16-16 of FIG. 15.

Bottom layer 30, also shown individually in FIGS. 9-11, has a generally rectangular, planar body 32 provided with a plurality of openings 34 configured to receive a plurality of ammunition cartridges 80. In one aspect the openings 34 are positioned in a matrix format. A cartridge 80 will sit upon a floor 35 (See FIG. 9, FIG. 10, FIG. 11) within the opening 34. As shown in FIG. 10, floor 35 is oriented at a bottom portion 35' of the first layer 30 and prevents access to openings 34 from an underside 35" of the first layer 30. Innermost walls 36 of the body 32 also in part define the openings 34. In one aspect the walls 36 form rounded corners 37 in a generally rectangular configuration. In one aspect the openings 34 are oriented with opposing corners 37*a*, 37*b*, aligned along a horizontal axis generally parallel with a linear left edge 38 of bottom layer 30; and with opposing corners 37*c*, 37*d*, aligned along a vertical axis generally parallel with a linear bottom edge 39 of bottom layer 30. Different orientations and geometries of the opening 34 may be provided. A different amount of openings 34 may also be provided in the layer 30. Different sized openings 34 may also be provided to accommodate receiving different sizes of cartridges 80. Bottom layer 30 also includes fastener apertures 33 each configured to receive a fastener 60. In aspects, layer 30 may also include rounded external edges. In other aspects, layer 30 may include holes running therethrough, instead of openings 34.

As shown in FIGS. 1 and 2, and various other Figures, a middle layer 40 is positioned above the bottom layer 30. Middle layer 40 is shown individually in FIGS. 12-14, and includes a plurality of holes 44. Holes 44 pass through layer 40. Holes 44 are configured to receive a plurality of ammunition cartridges 80. In one aspect the holes 44 are positioned in a matrix format. Cartridge 80 will pass through holes 44 of layer 40. Innermost walls 46 of the body 42 define the holes 44. In one aspect the walls 46 form rounded corners 47 in a generally rectangular configuration. In one aspect the holes 44 are oriented with opposing corners 47*a*, 47*b*, aligned along a horizontal axis generally parallel with a linear left edge 48 of middle layer 40; and with opposing corners 47*c*, 47*d*, aligned along a vertical axis generally parallel with a linear bottom edge 49 of middle layer 40. Different orientations and geometries of the holes 44 may be provided. A different amount of holes 44 may also be provided in the layer 40. Different sized holes 44 may also be provided to accommodate receiving different sizes of cartridges 80. In one aspect middle layer 40 is generally rectangular and includes rounded exterior corners. Middle layer 40 also includes elongated slots 43 each configured to receive a fastener 60.

As shown in FIGS. 1 and 2, and various other Figures, upper layer 50 is positioned above the middle layer 40. Upper layer 50 is shown individually in FIGS. 15-17, and includes a plurality of holes 54. Holes 54 pass through layer 50. Holes 54 are configured to receive a plurality of ammunition cartridges 80. In one aspect the holes 54 are positioned in a matrix format. Cartridge 80 will pass through holes 54 of layer 50. Innermost walls 56 of the body 52 define the holes 54. In one aspect the walls 56 form rounded corners 57 in a generally rectangular configuration. As shown in FIGS. 9, 11, 12, 14, 15 and 17, pairs of adjacent walls 36, 46, 56 associated with respective openings 34 and holes 44, 54 are oriented perpendicular each other. In one aspect the holes 54 are oriented with opposing corners 57*a*, 57*b*, aligned along a horizontal axis generally parallel with a linear left edge 58 of upper layer 50; and with opposing corners 57*c*, 57*d*, aligned along a vertical axis generally parallel with a linear bottom edge 58 of upper layer 50. Different orientations and geometries of the holes 54 may be provided. A different amount of holes 54 may also be provided in the layer 50. Different sized holes 54 may also be provided to accommodate receiving different sizes of cartridges 80. Upper layer 50 also includes fastener apertures 53 each configured to receive a fastener 60. In one aspect layer 50 is generally rectangular and includes a corner void 51 which exposes a top surface of the middle layer 40 when the upper layer is positioned above or upon the middle layer 40. In one aspect, layer 30 is generally rectangular and includes a corner void 31 which exposes a bottom surface of the middle layer 40 when the middle layer is positioned upon the bottom layer 30. The upper portions of holes 54 in one aspect include a beveled edge. The perimeter edge of upper layer 50 may also include a beveled edge 55.

Figure 8:
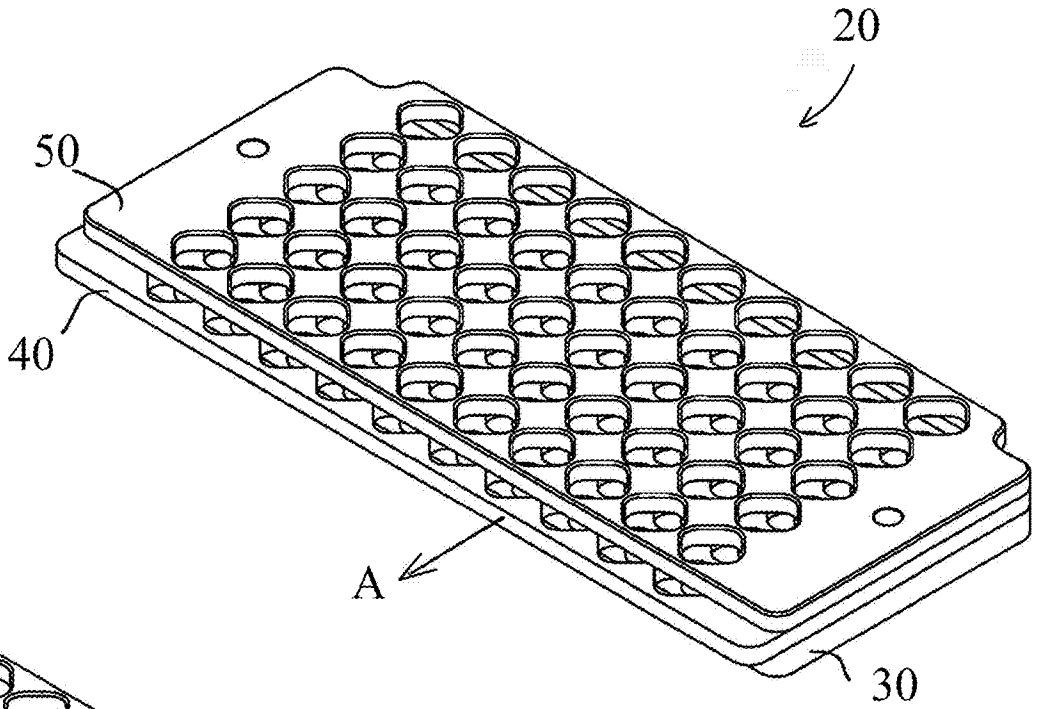
FIG. 8 is a perspective view of the device of FIG. 7 in an operational mode.
Figure 7:
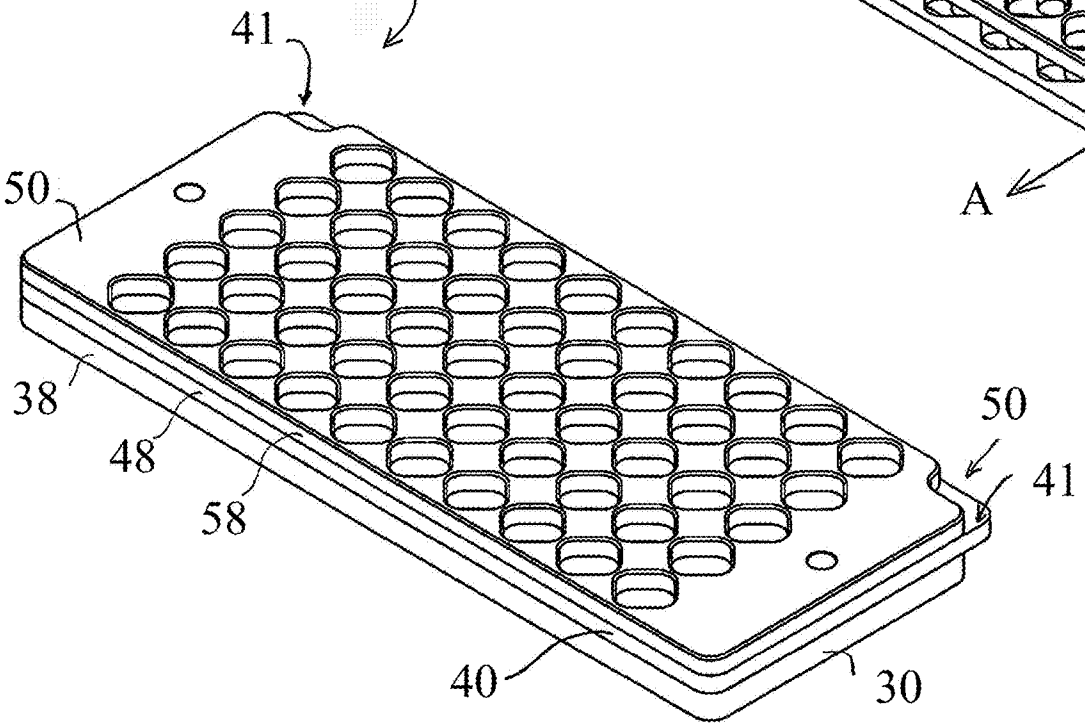
FIG. 7 is a perspective view of an ammunition cartridge block in accordance with one aspect of the invention.

In one aspect the holes 54, 44 align with openings 34. In one aspect the holes 54, 44 align with the openings 34 when the respective left edges 38, 48 and 58 are aligned along a common plane as shown in FIG. 7. In such alignment, and during a first use mode, device 20 is configured to receive a plurality of cartridges 80 by insertion of a cartridge 80 through holes 54, 44, and into opening 34. The aligned holes 54, 44 and opening 34 accommodate receipt of a cartridge 80. Different sized holes and openings will accommodate different sized cartridges 80. As shown in FIG. 8, middle layer 40 translates in the direction of arrow "A" such that holes 44 are off-set, at least in part, with respect to holes 54 and openings 34. In this mode of an off-set arrangement, which is a second use mode, inner walls 46 press against the cartridges 80 inserted into the holes and openings to hold the cartridges into position. More particularly, in one example, openings 34 have walls 36 forming a perimeter profile generally shown with reference number 65. The perimeter profile 65 is matched with a similar or identical perimeter profile 75 of middle layer 40. The perimeter profile 65 is also matched with a similar or identical perimeter profile 85 of top layer 50. When a hole 44 aligns with a hole 54 which aligns with an opening 34, a socket 95 (See FIG. 5) is created.

In one aspect device 20 is assembled with middle layer 40 set upon bottom layer 30, and upper layer 50 set upon middle layer 40. A set screw or fastener 60, or pair of fasteners 60, is inserted into the fastener aperture 53 of upper layer 50, through the elongated slot 43 of middle layer and into fastener aperture 33 of bottom layer. Fastener 60 in one aspect is threaded into bottom layer 30 and may be tightened and/or loosened. Turning or tightening of fastener 60 applies pressure to the top surface of layer 50 to press layer 50 tight against middle layer 40 which in turn presses against bottom layer 30. Fastener 60 may be tightened to set middle layer 40 into position to hold cartridges 80, or to maintain holes and openings in a clearance position to receive cartridges 80. A user may then fill or otherwise attend to preparation of the plurality of cartridges 80. Loosening fastener 60 allows middle layer 50 to slide or translate relative to bottom layer 30 and/or upper layer 50.

Figure 3:
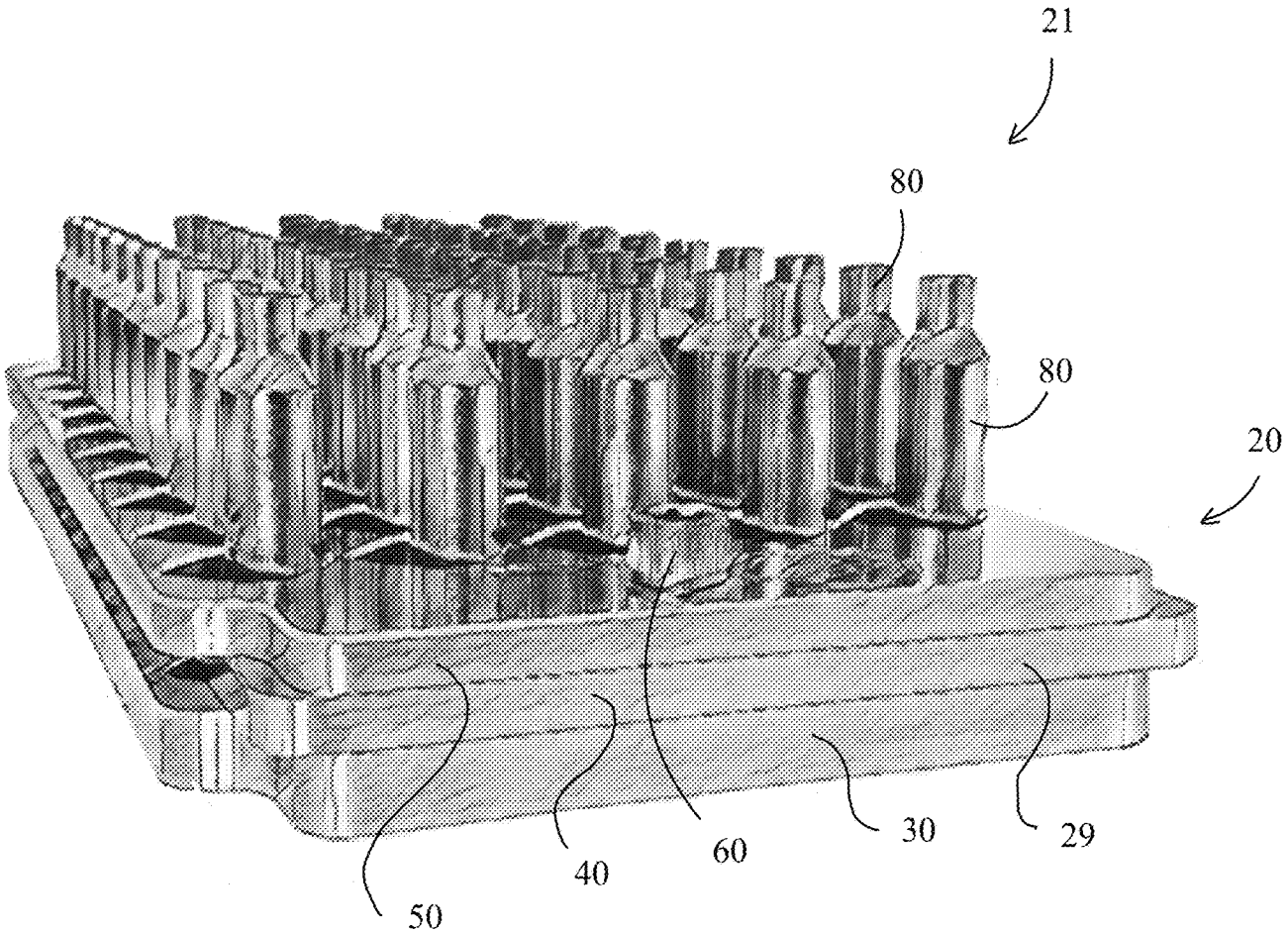
FIG. 3 is a perspective view of an ammunition cartridge block device in accordance with aspects of the invention and showing a plurality of secured cartridges for illustration.
Figure 4:
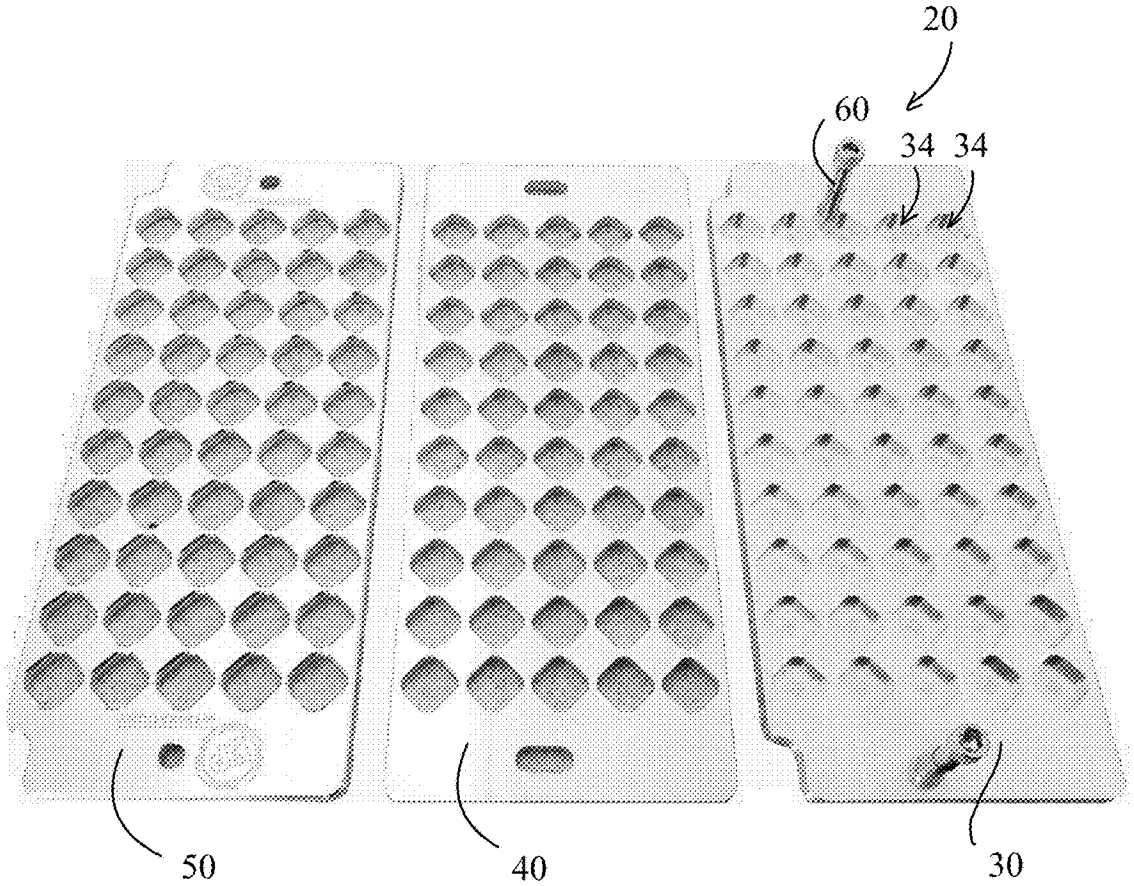
FIG. 4 is an exploded view of the device of FIG. 3 with the cartridges removed for clarity.
Figure 5:
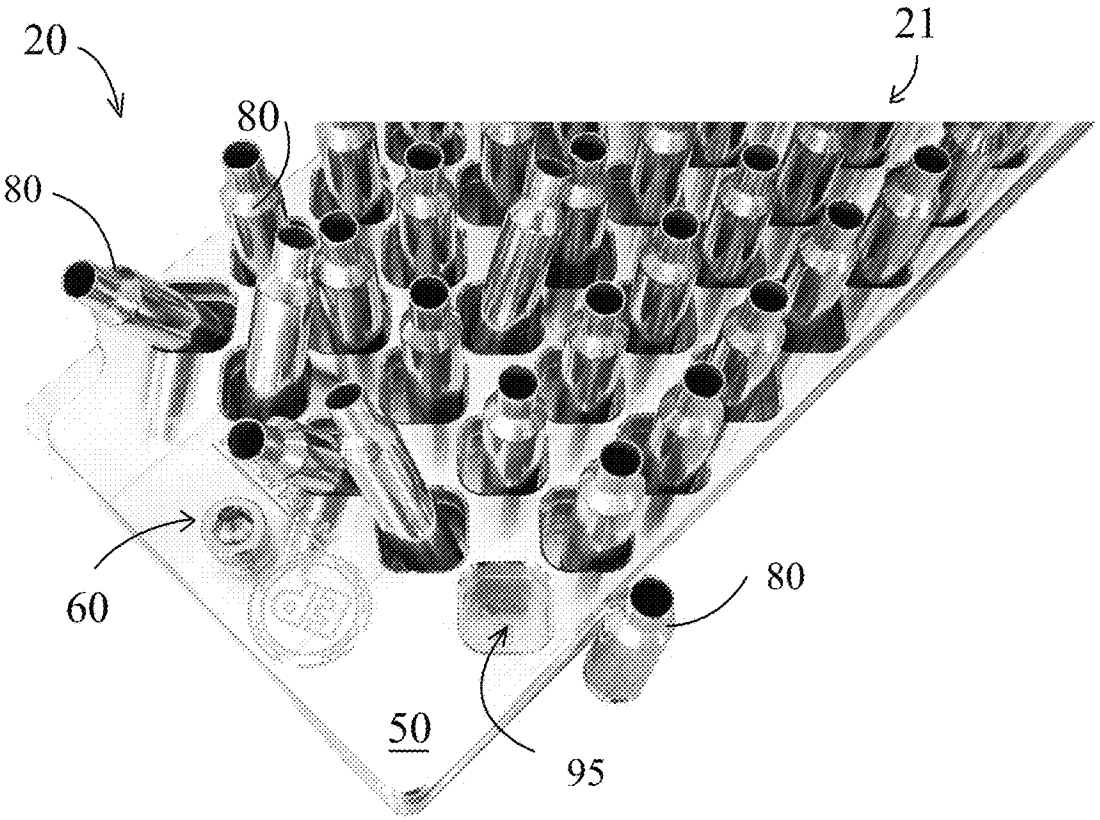
FIG. 5 is a partial perspective view of the device of FIG. 3 and also depicting one mode of operation.
Figure 6:
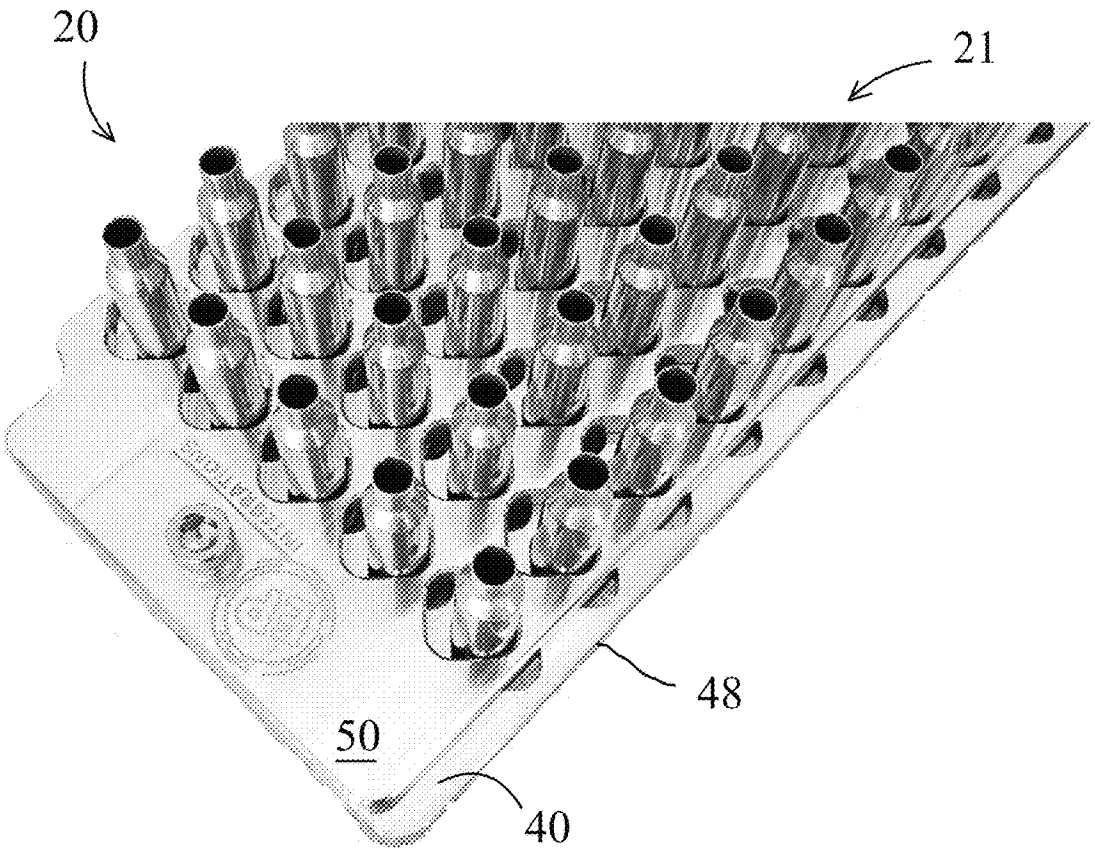
FIG. 6 is a partial perspective view of the device of FIG. 3 and also depicting a further mode of operation.

In operation a user may loosen the fasteners 60 and then slide the layers 30, 40, 50 (particularly layer 40) so that the layers are in alignment, with left edges 38, 48, 58 in general alignment as shown in FIG. 7. In one aspect this alignment results in corresponding alignment of the holes 54, 44 and apertures 34, thus creating sockets 95. Thus, when edges 38, 48 and 58 are aligned along a common plane, holes 54, 44 and apertures 34 are also in alignment as shown in FIG. 1, FIG. 5 and FIG. 7. Particularly, inner walls 36, 46, 56 of respective holes 44, 54 and openings 34 align along a common plane. A user may then place cartridges into the respective holes 54, 44 and openings 34 (sockets 95) as in FIG. 5. In such position the cartridges are loosely contained within the respective holes and openings. When the desired cartridges 80 are placed within the holes and openings, the user may translate (slide layer 40 in the direction of arrow A in FIG. 8) middle layer 40, thereby forcing the cartridges 80 to be secured within respective holes and openings and stand upright as shown in FIG. 7 and FIG. 3. The inner walls 46 of layer 40 press against sides of respective cartridges 80 while inner walls 56, 36 press against opposing sides of the respective cartridges. As shown in FIG. 6, the corners 47 (and associated walls 46) of layer 40 act to cradle a cartridge 80 and force the cartridge 80 against corners 37, 57 (and associated walls 36, 56) of layers 30, 50. Thus, the corners 37, 57 maintain an upper and lower contact against the cartridge while the corners 47 maintain a middle or central contact against the cartridge to securely hole the cartridge into position. Such three-stage level of contact assures a solid holding action and prevents the cartridges from moving within or from the device 20. The set screw or fasteners 60 are tightened to secure middle layer 40 into fixed position. The device 20 and system 21 which includes device 20 populated with at least one cartridge may be moved without worry of the cartridge or a plurality of cartridges wobbling, adjusting or being inadvertently removed from holes 54. When filing of the cartridges (or other use or treatment of the cartridges is accomplished), the fastener or fasteners 60 may be loosened, and the middle layer 40 translated (opposite arrow "A") to release the pressure upon the cartridges so the cartridges may be adjusted and/or removed from device 20.

In one aspect the holes 44, 54 and openings 34 are oriented as shown with opposing corners 47*a*, 47*b* aligned along the direction of travel or translation along arrow "A". In this configuration the respective corners of the holes 44, 54 and openings 34 operate to secure cartridges 80. It may be appreciated that alternative orientations, configurations and alignments may also be used for holes 44, 54 and openings 34 to secure the cartridges.

The adjustability of the effective hole sizes due to adjustability of middle layer 40 accommodates use of device 20 for a variety of cartridge sizes. In one example, holes 44, 54 and openings 34 have an opening area large enough to receive casings 80 at least of size 0.375 CheyTac, while also accommodating cartridges at least as small as 0.300 blackout, and various sizes between, such as 6.5 Grendel, 6.5 Creedmoor, 300 WSM, .338 Winchester, 0.375 CheyTac, 30-30, 0.223, among others. The device is not limited to any specific cartridge or cartridge size. Thus, the same device 20 may be used to hold and work with a great variety of cartridges, allowing a user a universal block and eliminating the need to purchase blocks of different varieties.

A further method aspect 100 includes a step of positioning at least a first cartridge 80 into a first hole 44 of a layer 40 and into a first opening 34 of a bottom layer 30 of a device 20, and translating the second layer 40 such that inner walls 46 or edges abut the cartridge. In one aspect walls or edges 46 associated with corner 47*b* (or portions of walls 46 associated with or adjacent the corners 47*b*) (See FIG. 15) of the plurality of holes 46 of layer 40 abut against surfaces of the cartridge 80, while edges 37*a* (or portions of walls 36 associated with or adjacent corners 47*a*) of layer 30 abut against opposite or opposing surfaces of the cartridge 80. Abutting against opposite surfaces holds or locks the cartridge 80 into position. In one aspect the edges 46 associated with corner 47*b* are "southern" edges of the plurality of holes 46 of layer 40 which abut against "southern" surfaces of the cartridge 80 when the cartridge 80 is inserted into the hole 44, while "northern" edges 36 associated with corner 37*a* (or portions of walls 36 associated with or adjacent the corner 37*b*)(See FIG. 11) of the plurality of openings 34 of layer 30 abut against opposite or opposing or "northern" surfaces or edges of the cartridge 80. It may be appreciated that the middle layer 40 may be configured to slide in a different direction so that different edges or surfaces of middle layer 40 are in contact with the surfaces or different surfaces of the cartridges. In the present example the layer 40 is configured to lock into position when layer 40 slides "downward" (i.e., "north" to "south") with respect to layer 30 and/or layer 50 (as in FIG. 8). It may be appreciated that the layers may be configured so that layer 40 locks cartridges when layer 40 slides "upward" with respect to layer 30 and/or layer 50. Device 20 may also be configured so that a sideways or East-West translation of layer 40 with respect to layer 30 and/or layer 50 operates to lock the cartridges.

In one aspect with respect to FIG. 6, a cartridge 80 is held into upright position by edges 46 of middle layer 40 abutting against one side of the cartridge 80 while walls or edges 36 of bottom layer 30 and walls or edges 56 of upper layer 50 abut against an opposite or generally opposite or opposing side of the cartridge 80. In one aspect, the walls or edges 46 of middle layer 40 contact cartridge 80 at two areas on cartridge 80 while walls or edges 36 of bottom layer 30 contact cartridge 80 at two areas on cartridge 80 which are opposite or generally opposite the two areas of contact by middle layer 40. In a case where corner 47 has a curve or radius which matches a curve or radius of cartridge 80, the wall 46 of middle layer 40 may achieve a continuous contact with the surface or an extended portion of the surface of cartridge 80.

In one aspect bottom layer 30 and/or upper layer 50 include a corner void 31, 51 to accommodate ease of moving middle layer 40. Corner voids 31, 51 provide convenient finger access to push against middle layer 40, where a portion of middle layer 40 is exposed and/or extends outward from voids 31, 51. Without such voids, 31, 51, and were the middle layer 40 to have an outer perimeter identical to layer 30 and/or layer 50, there would be no exposed portion 41 of layer 40 for convenient access or push/leverage surface to accommodate easier sliding of layer 40 between layers 30, 50.

The layers 30, 40, 50 may be made of metal or plastic or of a composite, blended, alloy or other material. In one aspect layers are made of aluminum. The holes and openings may be sized to receive a variety of sizes of cartridges, thus allowing users to avoid having to purchase, organize and maintain multiple different blocks for handling cartridges. Device 20 is universal in that it will accommodate a wide range of cartridge sizes. In some non-limiting examples, device 20 accommodates cartridge sizes of just under 0.300 blackout and just over 0.375 CheyTac. Different scaled (larger or smaller sized) devices may be used depending on desired needs. In one aspect device 20 has an overall length of 10.9 inches with a width of 4.5 inches. In one aspect bottom layer 30 has a thickness of about 0.365 inches, middle layer 40 a thickness of about 0.240 inches, and upper layer 50 of about 0440 inches. Other sizes and dimensions are contemplated without departing from the spirit of the invention.

It should be understood, of course, that the foregoing relates to exemplary embodiments of the invention and that modifications may be made without departing from the spirit and scope of the invention as set forth in the following claims.

We claim:

1. A device comprising:

a first layer having a plurality of openings configured to receive a plurality of ammunition cartridges, at least one of the openings configured to prevent a cartridge from passing through the first layer; and a second layer having a plurality of holes configured to receive the plurality of ammunition cartridges, the second layer positioned above the first layer and configured to translate with respect to the first layer.

2. The device of claim 1 where at least one of the holes of the second layer aligns with at least one of the openings of the first layer such that a cartridge passes through the at least one hole and into the at least one opening.

3. The device of claim 2 where the second layer includes at least one elongated slot passing through the second layer, a fastener positioned at the first layer extends upward through the elongated slot.

4. The device of claim 1 where at least one of the holes has an innermost wall having a first perimeter profile, and at least one of the openings has an innermost wall having a second perimeter profile, the first perimeter profile being identical to the second perimeter profile.

5. The device of claim 1 where the first layer has a first maximum width and first maximum length, the second layer has a second maximum width and second maximum length, the first maximum length being identical the second maximum length, the first maximum width being identical the second maximum width.

6. The device of claim 1 further comprising a third layer having a plurality of holes configured to receive the plurality of ammunition cartridges, the third layer positioned above the second layer.

7. The device of claim 6 where the third layer is set in a fixed position with respect to the first layer.

8. The device of claim 6 where the plurality of holes of the third layer align with the plurality of holes of the second layer and the plurality of openings of the first layer.

9. The device of claim 6 where the first layer has a first layer left edge, the second layer has a second layer left edge, and the third layer has a third layer left edge, the left edges aligned along a common plane when the device is in a first use mode.

10. The device of claim 9 where the second layer left edge is translated from the common plane when the device is in a second use mode.

11. The device of claim 10 where a cartridge positioned through a hole of the third layer simultaneously passes through a corresponding hole of the second layer and into a corresponding opening of the first layer, whereby the cartridge is held into an upstanding position within the respective holes and opening.

12. The device of claim 7 where the second layer is slidably fastened between the first layer and the third layer.

13. The device of claim 6 where the third layer has an outer perimeter defining a corner void such that when the second layer is aligned under the third layer, an upper surface of the second layer at a corner portion of the second layer is exposed.

14. The device of claim 6 further comprising at least one set-screw fastener passing through the third layer and through the second layer and into the first layer, the set-screw fastener adjustable to fix the second layer into a set position with respect to the first layer.

15. A method of securing an ammunition cartridge within a block device, the method comprising:

positioning a first ammunition cartridge into a first hole of a third layer and through a first hole of a second layer and into a first opening of a first layer of the block device, the first opening configured to prevent the first ammunition cartridge from passing through the first layer; and adjusting the second layer such that walls of the first hole of the second layer abut the first ammunition cartridge.

16. The method of claim 15 where walls of the first hole of the third layer and walls of the first opening of the first layer abut the first cartridge.

17. The method of claim 16 where the walls of the first hole of the third layer are oriented generally opposite the walls of the first hole of the second layer.

18. The method of claim 15 further comprising securing at least another ammunition cartridge within the block, the another ammunition cartridge positioned into a second hole of the third layer and through a second hole of the second layer and into a second opening of a first layer of a block, and translating the second layer such that walls of the second hole of the second layer abut the second cartridge to hold the cartridge upright within the block.

19. A device comprising:

a first layer having a plurality of openings configured to receive a plurality of ammunition cartridges, at least one of the openings configured to prevent a cartridge from passing through the first layer;

a second layer having a plurality of holes alignable with the plurality of openings and configured to receive the plurality of ammunition cartridges, the second layer positioned above the first layer; and a third layer having a plurality of holes aligned with the plurality of openings and configured to receive the plurality of ammunition cartridges, the third layer positioned above the second layer, the second layer adjustable with respect the first layer.

20. The device of claim 19 further comprising an adjustable fastener to connect the first layer, second layer and third layer such that the second layer may be selectively adjusted, and set into a fixed position, with respect to the first layer, whereby the plurality of holes of the second layer are in-part offset with the plurality of openings.

21. The device of claim 1 where the at least one of the openings is defined in part by a floor of the first layer which floor prevents a cartridge from passing through the first layer.

22. The device of claim 21 where the floor is oriented at a bottom portion of the first layer and prevents access to the at least one opening from an underside of the first layer.

23. The method of claim 15 where the first opening is defined in part by a floor of the first layer which floor prevents the first ammunition cartridge from passing through the first layer.

24. The method of claim 17 where the walls of the first hole of the third layer include a pair of walls which are oriented perpendicular each other, and the walls of the first hole of the second layer include a pair of walls which are oriented perpendicular each other.

* * * * *